United States Patent [19]

Murray

[11] Patent Number: 4,961,393

[45] Date of Patent: Oct. 9, 1990

[54] ANTI-PROJECTILE PROTECTION FENCE AND METHOD FOR MARINE SURFACE VESSELS

[76] Inventor: Myles N. Murray, 15 Skyline Dr., Chagrin Falls, Ohio 44022

[21] Appl. No.: 414,616

[22] Filed: Sep. 25, 1989

Related U.S. Application Data

[63] Continuation of Ser. No. 412,763, Aug. 30, 1982, abandoned.

[51] Int. Cl.[5] ..... B63G 8/24; F41H 13/00

[52] U.S. Cl. ..... 114/240 R; 89/1.1; 114/240 D

[58] Field of Search ..... 114/240 R, 240 A, 240 B, 114/240 C, 240 D, 240 E, 241, 244; 89/1.1; 102/402

[56] References Cited

U.S. PATENT DOCUMENTS

| | | | |
|---|---|---|---|
| 1,139,113 | 5/1915 | Evans | 114/240 D |
| 1,171,153 | 2/1916 | Steinmetz | 114/240 R |
| 1,184,928 | 5/1916 | Conners | 114/240 R |
| 1,249,107 | 12/1917 | Johnson | 114/241 |
| 2,365,066 | 12/1944 | Fuller | 114/240 R |
| 2,369,464 | 2/1945 | Kalnitz | 114/240 R |
| 2,383,095 | 8/1945 | Wallace | 114/240 R |
| 2,395,056 | 2/1946 | Luby | 114/240 R |
| 2,941,493 | 6/1960 | Glennon et al. | 114/240 R |
| 2,968,274 | 1/1961 | Estes | 114/240 R |
| 4,231,311 | 11/1980 | Longerich | 114/244 |
| 4,262,595 | 4/1981 | Longerich | 102/402 |

FOREIGN PATENT DOCUMENTS

| | | | |
|---|---|---|---|
| 152040 | 10/1920 | United Kingdom | 114/240 |

*Primary Examiner*—David H. Brown

*Attorney, Agent, or Firm*—Renner, Otto, Boisselle & Sklar

[57] ABSTRACT

A ship or other marine surface vessel to be protected against torpedo or missile attack tows therebehind an articulated train of floating projectile barriers. To defense on attack, the ship circles away from the attacker to a position behind a trailing portion of the floating barrier train. Each floating barrier includes a solid wall, torpedo intercepting keel or hull which is buoyant, horizontally stabilized and supports thereon a missile intercepting fence extending above the surface of the water. Provision is made for drawing projectiles to the floating barriers and for determining the position of the attacker.

16 Claims, 1 Drawing Sheet

ANTI-PROJECTILE PROTECTION FENCE AND METHOD FOR MARINE SURFACE VESSELS

This is a continuation of co-pending application Ser. No. 06/412,763 filed on Aug. 30, 1982, now abandoned.

DISCLOSURE

This invention relates generally, as the title indicates, to an anti-projectile protection fence and method for marine surface vessels and, more particularly, to such a fence and method which affords protection against projectiles of both the torpedo and surface missile types.

BACKGROUND

Ships and other marine surface vessels, and particularly those which are unarmed or incapable of mounting a counter-attack, are particularly vulnerable to torpedo and surface missile attack by submarines, aircraft or surface warships. The only defensive measure the vessel being attacked may be able to take is randomly to change course, this commonly being referred to as zigzagging. Such maneuver, however, is not extremely effective particularly in light of modern-day guided missiles and torpedoes which have the ability to change their course and home-in on the vessel. Accordingly, the vessel which may be vital to a nation's defense may be destroyed or seriously damaged.

Various attempts have been made to afford surface vessels a greater degree of protection against projectile attack. One such attempt, disclosed in U.S. Pat. No. 2,369,464, provides a torpedo intercepting apparatus comprising a series of articulated screens or elements. Each screen element includes a series of spaced vertical rods and longitudinal tie rods which extend above and below the surface of the water, and an articulated screen is towed at each side of the vessel by means of a boom secured to the bow of the vessel. To defense against an attack, propulsion devices at the lead ends of the screens cause the booms to pivot away from the vessel, thus to locate the screens in laterally spaced relationship with respect to the vessel. If a torpedo detonates upon striking a screen, the resultant explosion may be sufficiently spaced from the vessel to prevent serious damage. Alternatively, the torpedo causes the screen to rotate whereby the momentum of the torpedo is converted in part to a turning moment acting upon the screen and in part to a component tending to move the screen toward the vessel. It is noted, however, that an anticipated drawback of such apparatus is that a second trailing torpedo may be permitted to pass once a first torpedo has caused the screen to rotate to a horizontal position. Moreover, the vessel with such screens deployed would still be vulnerable to frontal and rear attack.

In U.S. Pat. No. 2,968,274, another type of anti-torpedo system can be seen to employ one or more flexible tubes or streamers which are towed by a vessel through the water at a predetermined depth of submergence and in predetermined laterally spaced relation with respect to the vessel. A plurality of microphonic detecting devices are arranged at intervals along respective streamers whereas explosive charges are disposed along the length of respective streamers, each explosive charge being of sufficient size to deflect, disable or destroy an oncoming torpedo as the charge is fired by a signal received through the water by the microphonic detecting devices. Perhaps the major drawback of this type of protection system is its complexity which may render it prone to failure. Moreover, such system may not be effective against projectiles traveling above the surface of the water.

SUMMARY OF THE INVENTION

The present invention provides an inexpensive and simple solution to the problem of protecting marine surface vessels against torpedo and surface missile attack. In accordance with the invention, the vessel to be protected tows therebehind an articulated train of floating projectile intercepting barriers. To defense an attack, the vessel circles away from the attacker to a position behind a trailing portion of the floating barrier train. That is, the vessel circles so as to position the trailing portion of the train between itself and the attacker thereby to deny projectiles issued by the attacker a clear path to the thus protected vessel.

In particular, the floating barriers include solid wall, torpedo intercepting keels or hulls which are buoyant and support thereon a missile intercepting fence extending above the surface of the water. The keels preferably are made of steel or other ferrous material which would cause torpedoes having magnetic or proximity-type triggers to be detonated upon contact therewith a safe distance away from the protected vessel. One or more decoy devices may be mounted on the floating barriers to draw guided or homing projectiles thereto. In addition, detector devices also may be carried by and spaced along the length of the floating barrier train for the purpose of detecting the position of the attacker such as by triangulation.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, but one of the various ways in which the principles of the invention may be employed.

DETAILED DESCRIPTION

Figure 1:
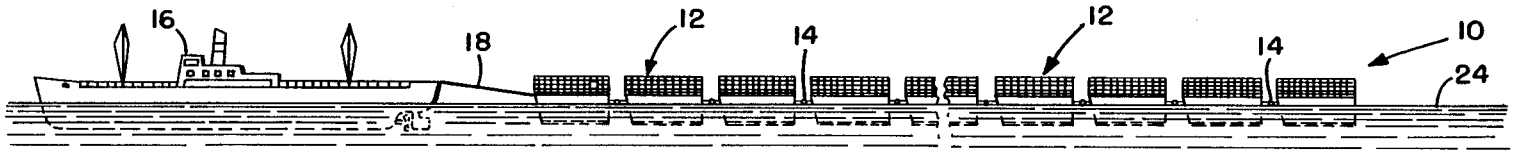
FIG. 1 is an elevation view of the anti-projectile protection fence as employed in combination with a marine surface vessel in accordance with the present invention.

Referring now in detail to the drawing and initially to FIG. 1, an anti-projectile fence according to the present invention is designated generally by reference numeral 10. The fence 10 comprises a plurality of floating projectile intercepting barriers 12 which are connected end-to-end by articulated joints 14. The lead barrier also is detachably connected at the bow thereof to the stern of a marine surface vessel 16 by a tow line 18. Accordingly, the floating barriers form an articulated train towed or pulled behind the vessel 16. Preferably, wire netting is provided between adjacent floating barriers to ensure against the remote possible passage of a projectile therebetween.

Figure 3:
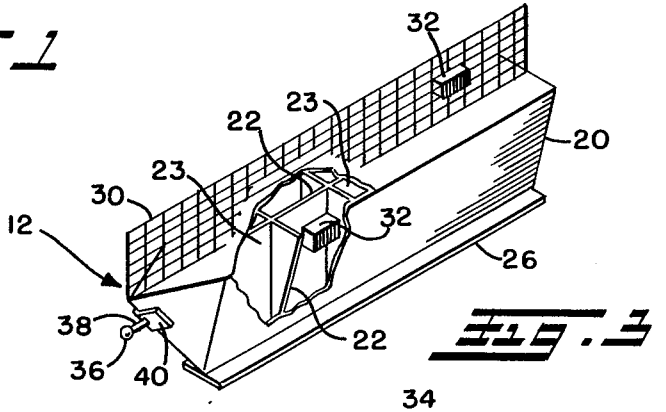
FIG. 3 is a perspective view, partly broken away, of one floating barrier of the fence of FIG. 1.

With additional reference to FIG. 3, each floating barrier 12 can be seen to include a narrow, V-shaped keel or hull 20 which has a tapered bow and square stern. The keel 20 is of a fabricated construction consisting of solid walls or plates which are assembled in the manner shown. Together the various plates form a water-tight hollow interior which is divided by bulkheads 22 into individual flotation chambers 23. Although the keel 20 desirably is dimensioned to be self-floating, additional flotation may be provided as desired. As seen in FIG. 1, the upper portion of each keel preferably extends slightly above the water surface 24.

The dimensions of the keel 20 also are such that the keel provides an effective barrier to a torpedo traveling on just below the water surface 24. The keel for example may have a draft of about 20 feet although a lesser or greater draft may be desirable depending on the draft of the vessel 16 being protected. Preferably, the keel has a draft approximately equal that of the vessel being protected so that any torpedo traveling at a depth sufficient to pass under the keel also would likewise pass under the vessel. With a draft or height of about 20 feet, the keel may have a length of about 40 feet.

For ultimate effectiveness, the solid plates forming the keel are of steel or other ferrous metal. Accordingly, torpedoes having magnetic or proximity-type triggers would be detonated upon striking the keel.

At the bottom or vertex of the keel 20, there is fixed a horizontal stabilizer in the form of an elongate horizontal plate 26. The stabilizer 26 serves to resist upward and downward motion of the keel due to wave action. Accordingly, the keel will not rise and fall with waves to any substantial degree with the result that desired extension of the keel beneath the surface of the water will be maintained with respect to the mean surface height of the water.

Supported on top of the keel 20 is a vertical fence or grid work 30. The grid work 30 extends above the surface of the water to form an intercept for surface missiles as well as for torpedoes that may skip along the surface of the water. As shown, the grid work extends substantially the length of the keel and should have a mesh size which provides for capture or detonation of a torpedo or missile striking thereagainst.

As also seen in FIG. 3, the floating barrier 12 may carry one or more boxes 32 which house detector and/or decoy devices. As shown, the device boxes may be conveniently mounted in the hollow of the keel 20 or on the missile intercept grid work 30. With respect to detector devices, two or more of them may be carried on respective floating barriers 12 for the purpose of determining the position of an attacker, whether ship, submarine or plane, such as by triangulation. For instance, a detector device, such as a sonar device, may be provided on the leading and trailing floating barriers to provide a relatively long base side for triangulation purposes. As for the decoy devices, such may be employed to draw homing or guided missiles and torpedoes toward the fence rather than the vessel being protected. For example, such devices might generate an electro-magnetic or sonic screen or mask making the fence look like a large ship such as an aircraft carrier which the missile or torpedoes then might seek.

It also is noted that the floating barriers may carry counter-measure devices such as homing anti-submarine torpedoes.

Figure 5:
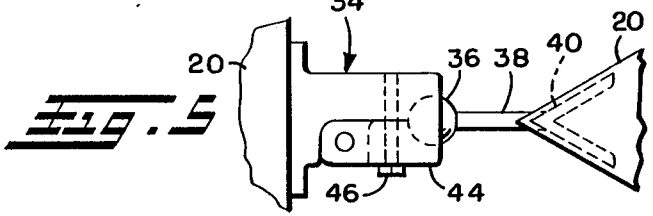
FIG. 5 is a fragmented top plan view of the joint of FIG. 4 as seen from the line 5—5 thereof.
Figure 4:
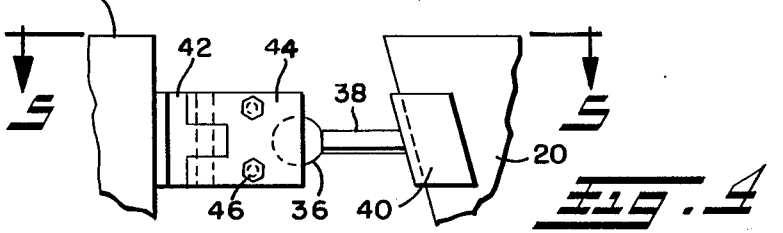
FIG. 4 is a fragmented elevation view of an articulated joint interconnecting adjacent floating barriers.

Additional reference now being made to FIGS. 4 and 5, the articulated joint 14 connecting adjacent floating barriers 12 can be seen to include a ball hitch 34 mounted on the stern of one barrier and a cooperating ball 36 mounted by a stem 38 and V-plate 40 to the bow of the other barrier. The ball hitch 34 includes a fixed jaw 42 and a hinged jaw 44 which when closed and secured together by fasteners 46 form a socket in which the ball 36 is trapped. The ball, however, can swivel in the socket to accomodate relative pitching and rolling movement of the floating barriers due to wave action and course change.

Figure 2:
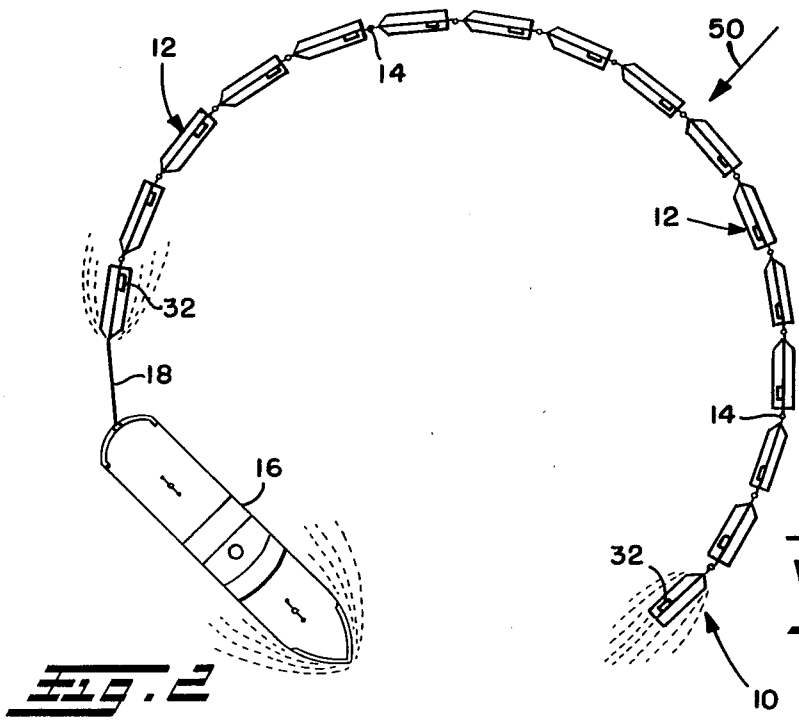
FIG. 2 is a plan view of the vessel/fence combination illustrating a defensive position thereof.

Referring again to FIG. 1, and additionally to FIG. 2, the usage of the protection fence 10 will now be discussed. As seen in FIG. 1, the fence 10, i.e., the articulated train of floating barriers 12, is connected to and towed behind the vessel 16. When an attacker is in the vicinity, such being detected by radar, sonar or by visual sight, the ship would then circle away from the attacker to a position behind a trailing portion of the protection fence. As seen in FIG. 2, the ship has already performed such defensive maneuver with the result that the trailing portion of the fence is disposed between the ship and the attack line indicated by arrow 50. As a result, any torpedoes or missiles directed at the ship along the attack line 50 must first encounter the protection fence at a point remote from the ship. Accordingly, the projectiles will either be deflected away, captured or detonated by the fence without damage to the ship. In the event a torpedo or missile does strike the floating barrier, it will be appreciated that the barrier, to the extent it remains intact, will not pivot in the water because of its solid wall construction so as to preclude passage thereby of a second trailing torpedo or missile. Moreover, the damaged barrier may be maintained afloat by adjacent undamaged barriers and any flotation compartments 23 therein which remain intact.

It is noted that the length of the protection fence or train 10 should be selected to permit the foregoing defensive maneuver. In part, the length will depend on the turning radius of the vessel 16. That is, the greater the turning radius, the longer the train must be to insure full protection against attack. If the train is sufficiently long, the ship could continue to move away from the attacker and still be protected as by traveling an S-shape course within the protective area afforded by the protection fence.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

The embodiments of the invention in which an exclusive property or privilege is claimed are defined as follows:

1. In combination, a marine surface vessel and elongate projectile intercepting means connected to said vessel for towed transport therebehind, said elongate projectile intercepting means having a length such that said vessel can circle away from an armed attacker to a position behind a trailing portion of said elongate projectile intercepting means, said elongate projectile intercepting means including an articulated train of floating projectile intercepting barriers connected to the stern of said vessel, each floating barrier including a narrow torpedo intercepting keel extending substantially the length thereof, said keel having solid walls forming a water-tight hollow interior and said keel having a draft about equal or greater than that of said vessel.

2. The combination of claim 1, including bulkheads dividing the hollow interior into individual flotation chambers.

3. The combination of claim 1, wherein said keel is provided with horizontal stabilizer means for resisting both upward and downward motion of the keel due to wave action.

4. The combination of claim 1, wherein each floating barrier includes substantially along the length thereof a missile intercepting fence extending above the water surface.

5. The combination of claim 1, wherein detector means are spaced along the length of said elongate projectile intercepting means for detecting the position of such attacker.

6. The combination of claim 1, wherein said elongate projectile intercepting means includes decoy means for drawing a projectile thereto.

7. The combination of claim 1, wherein said keel is buoyant.

8. The combination of claim 6, wherein each floating barrier includes a missile intercepting fence mounted on top of the respective keel, said fence extending substantially the length of said barrier and above the water surface.

9. An anti-projectile protection fence for marine surface vessels comprising an articulated chain of floating projectile intercepting barriers adapted to be towed as a train behind the vessel, each barrier including a narrow torpedo intercepting keel, said keel having solid walls forming a water-tight hollow interior and said keel having a draft of about 20 feet or more.

10. The protection fence of claim 9, wherein each floating barrier includes substantially along the length thereof a missile intercepting fence extending above the water surface.

11. The protection fence of claim 9, wherein detector means are spaced along the length of said chain for detecting the position of an attacker.

12. The protection fence of claim 9, wherein said chain carries decoy means for drawing a projectile thereto.

13. The protection fence of claim 9, including bulkheads dividing the hollow interior into individual flotation chambers.

14. The protection fence of claim 13, wherein said keel is provided with horizontal stabilizer means for resisting both upward and downward motion of the keel due to wave action.

15. The protection fence of claim 9, wherein said keel is buoyant.

16. The protection fence of claim 15, wherein each floating barrier includes a missile intercepting fence mounted on top of the respective keel, said fence extending substantially above the water surface.

* * * * *